US011158276B1

(12) United States Patent
Xiao

(10) Patent No.: US 11,158,276 B1
(45) Date of Patent: Oct. 26, 2021

(54) DRIVING METHOD FOR LIQUID CRYSTAL DISPLAY PANEL

(71) Applicant: TCL China Star Optoelectronics Technology Co., LTD., Guangdong (CN)

(72) Inventor: Jianfeng Xiao, Shenzhen (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 206 days.

(21) Appl. No.: 16/617,100

(22) PCT Filed: Sep. 30, 2019

(86) PCT No.: PCT/CN2019/109342
§ 371 (c)(1),
(2) Date: Nov. 26, 2019

(87) PCT Pub. No.: WO2021/046946
PCT Pub. Date: Mar. 18, 2021

(30) Foreign Application Priority Data

Sep. 12, 2019 (CN) ..... 201910867164.7

(51) Int. Cl.
*G09G 3/36* (2006.01)

(52) U.S. Cl.
CPC ..... *G09G 3/3677* (2013.01); *G09G 3/3607* (2013.01); *G09G 3/3688* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,741,128 | B2 * | 8/2020 | Zhang | G09G 3/3685 |
| 11,043,189 | B2 * | 6/2021 | Choi | H01L 27/3276 |
| 2016/0012800 | A1 * | 1/2016 | Han | G09G 3/3233 345/213 |
| 2017/0330503 | A1 * | 11/2017 | Yang | H01L 27/326 |
| 2020/0358971 | A1 * | 11/2020 | Shim | H04N 5/3698 |

* cited by examiner

*Primary Examiner* — Van N Chow
(74) *Attorney, Agent, or Firm* — Benesch, Friedlander, Coplan & Aronoff LLP

(57) ABSTRACT

A driving method for a liquid crystal display panel is provided. The driving method in a first stage of the N+1th frame makes the first to the mth scan lines respectively control the first row to the mth row of subpixels to be sequentially turned on to make the m+1th to the 2mth of the scan lines respectively control the m+1th row to the 2mth row of the subpixels to be sequentially turned on, and transmits the overdrive voltage corresponded to the overdrive grayscale value to the subpixel during each subpixel being turned on; and in a second stage of the N+1th frame, does same as the first stage before transmits the overdrive voltage, and then transmits the driving voltage corresponded to the second grayscale value to the subpixel during each subpixel being turned on. Furthermore, the nth scan line and the n+mth scan line are simultaneously turned on.

10 Claims, 5 Drawing Sheets

DRIVING METHOD FOR LIQUID CRYSTAL DISPLAY PANEL

FIELD OF INVENTION

The present disclosure relates to the field of display technology, and particularly relates to a driving method for a liquid crystal display panel.

BACKGROUND OF INVENTION

With development of display technology, liquid crystal displays (LCDs) and such flat-panel display devices have advantages of high picture quality, power savings, thin bodies and wide application range, having been widely applied in mobile phones, televisions, personal digital assistants, laptops, desktop computers and such consumer electronics, having be mainstream display devices.

Most the liquid crystal display devices in the market are backlight type liquid crystal display devices, which include liquid crystal display panels and backlight modules. The working principle of a liquid crystal display panel is to place liquid crystal molecules in two parallel glass substrates, and control the liquid crystal molecules to change directions by applying electricity or not, and refract light of a backlight module to form images.

In driving processes of a liquid crystal display panel, due to the limitation of response speed of liquid crystals, it is difficult to achieve an expected deflection angle in a time of one frame, thereby making display brightness cannot achieve expectation, and smear is shown on dynamic images. For overcoming the defect mentioned above, overdrive (OD) technology is provided in the prior art to make liquid crystals to achieve the expected deflection target in short time. The principle of the OD technology is that when switching from a previous frame grayscale value to a present frame grayscale value, if only a target driving voltage corresponded to the present frame grayscale value is provided, since the response speed of deflection of liquid crystals is slow, actually, the present frame grayscale value cannot be achieved at the end of the present frame. However, using the OD technology, which provides a higher driving voltage or a lower driving voltage than the target driving voltage corresponded to the present frame during the present frame, thereby speeding up the liquid crystal deflection speed, thereby enabling to achieve the actual required present frame grayscale value at the end of the present frame to solve the problem of the smear.

In order to realize the OD technology, an OD lookup table (LUT) is generally disposed in the prior art. The OD lookup table stores grayscale interpolations respectively corresponded to a plurality of combinations of previous frame grayscale values and present frame grayscale values. During the overdrive, by the corresponding grayscale interpolation searched from the previous frame grayscale values and the present frame grayscale values acting as the overdrive grayscale value, the overdrive is realized.

Please refer to FIG. 1, setting L as a positive integer, in a present overdrive process, in the L+1th frame, making a grayscale interpolation corresponded to a combination of a first grayscale value of an Lth frame of displayed images and a second grayscale value of an L+1th frame of pending displayed images which correspond to subpixels in the OD lookup table to act as an overdrive grayscale value, and transmitting an overdrive voltage corresponded to the overdrive grayscale value to the subpixel, so that, in the L+1th frame, the liquid crystals of the subpixel can be deflected rapidly, and the subpixels can display the corresponding second grayscale value in one frame period. An action time of the overdrive in this method is one frame period, although this can prevent the subpixels from not able reaching a required grayscale value, the overdrive time is long, which makes response time of the liquid crystal display panel become slow.

SUMMARY OF INVENTION

The purpose of the present disclosure is to provide a driving method for a liquid crystal display panel, which has a short overdrive action time, and the response time of the liquid crystal display panel is improved.

In order to realize the purpose mentioned above, the present disclosure provides a driving method for a liquid crystal display panel, including the following steps:

Step S1, providing the liquid crystal display panel. The liquid crystal display panel includes a plurality of subpixels, and 2m scan lines, and each row of the subpixels are correspondingly electrically connected to one of the scan lines, and wherein m is a positive integer.

Step S2, obtaining a first grayscale value of an Nth frame of displayed images and a second grayscale value of an N+1th frame of pending displayed images which are corresponded to each subpixel, and obtaining an overdrive grayscale value corresponded to the subpixel according to the first grayscale and the second grayscale value corresponded to each subpixel, and wherein N is a positive integer.

Step S3, entering a first stage of the N+1th frame:

Making the first to the mth of the scan lines respectively control the first row to the mth row of the subpixels to be sequentially turned on, and meanwhile making the m+1th to the 2mth of the scan lines respectively control the m+1th row to the 2mth row of the subpixels to be sequentially turned on, and transmitting an overdrive voltage corresponded to the overdrive grayscale value corresponded to the subpixel to the subpixel during each subpixel being turned on. Furthermore, the nth scan line and the n+mth scan line are simultaneously turned on, and wherein n is a positive integer, and n is greater than 1 and less than m.

Step S4, entering a second stage of the N+1th frame:

Making the first to the mth of the scan lines respectively control the first row to the mth row of the subpixels to be sequentially turned on, and meanwhile making the m+1th to the 2mth of the scan lines respectively control the m+1th row to the 2mth row of the subpixels to be sequentially turned on, and transmitting a driving voltage corresponded to the second grayscale value corresponded to the subpixel to the subpixel during each subpixel being turned on. Furthermore, the nth scan line and the n+mth scan line are simultaneously turned on.

A duration of the first stage of the N+1th frame is a half of a preset frame period, and a duration of the second stage of the N+1th frame is a half of the preset frame period.

A duration of the first stage of the N+1th frame is less than a half of a preset frame period.

The liquid crystal display panel includes a plurality of data lines, and each row of the subpixels are correspondingly electrically connected to one of the data lines.

In the step S3, using the corresponding data lines to transmit the overdrive grayscale value corresponded to the overdrive grayscale value corresponded to the subpixel to the subpixel during each subpixel being turned on.

In the step S4, using the corresponding data lines to transmit the driving voltage corresponded to the second grayscale value corresponded to the subpixel to the subpixel during each subpixel being turned on.

The liquid crystal display panel includes a plurality of source drivers, and the source drivers are respectively electrically connected to the plurality of data lines.

In the step S3, using the corresponding data lines to transmit the overdrive voltage corresponded to the overdrive grayscale value corresponded to the subpixel to the subpixel by the source drivers electrically connected to the corresponding data lines during each subpixel being turned on.

In the step S4, using the corresponding data lines to transmit the driving voltage corresponded to the second grayscale value corresponded to the subpixel to the subpixel by the source drivers electrically connected to the corresponding data lines during each subpixel being turned on.

Each subpixel includes a thin film transistor, a storage capacitor, and a liquid crystal capacitor. A gate electrode of the thin film transistor is electrically connected to the corresponding data line, a drain electrode of the thin film transistor is electrically connected to the corresponding data line, and a source electrode of the thin film transistor is electrically connected to one end of the storage capacitor. Another end of the storage capacitor is grounded. One end of the liquid crystal capacitor is electrically connected to the source electrode of the thin film transistor, and another end of the liquid crystal capacitor is grounded.

The liquid crystal display panel includes 2i gate drivers, wherein i is a positive integer. The first to the ith of the gate drivers are respectively electrically connected to the first to the mth of the scan lines, and the i+1th to the 2ith of the gate drivers are respectively electrically connected to the m+1th to the 2mth of the scan lines.

In the step S3, using the first to the ith of the gate drivers to sequentially transmit scanning signals to the first to the mth of the scan lines, making the first to the mth of the scan lines respectively control the first row to the mth row of the subpixels to be sequentially turned on, and meanwhile using the i+1th to the 2ith of the gate drivers to sequentially transmit scanning signals to the m+1th to the 2mth of the scan lines, making the m+1th to the 2mth of the scan lines respectively control the m+1th row to the 2mth row of the subpixels to be sequentially turned on, and the nth the scan line and the n+mth scan line are simultaneously turned on.

In the step S4, using the first to the ith of the gate drivers to sequentially transmit the scanning signals to the first to the mth of the scan lines, making the first to the mth of the scan lines respectively control the first row to the mth row of the subpixels to be sequentially turned on, and meanwhile using the i+1th to the 2ith of the gate drivers to sequentially transmit the scanning signals to the m+1th to the 2mth of the scan lines, making the m+1th to the 2mth of the scan lines respectively control the m+1th row to the 2mth row of the subpixels to be sequentially turned on, and the nth scan line and the n+mth scan line are simultaneously turned on.

A number of the gate drivers is less than a number of the scan lines, and each gate driver is electrically connected to at least two of the scan lines.

Each gate electrode is accessed a start control signal, and after a rising edge of the accessed start control signal arrives, each gate driver sequentially transmits the scanning signal to the at least two of the connected scan lines.

The nth scan line is electrically connected to the n+mth scan line.

The step S2 is specifically: providing an overdrive lookup table, and the overdrive grayscale value includes a plurality of grayscale interpolations, and each grayscale interpolation is corresponded to a combination of a previous frame grayscale value and a present frame grayscale value, and the grayscale interpolation corresponded to the combination of the first grayscale value and the second grayscale value corresponded to each subpixel searched from the overdrive lookup table acts as the overdrive grayscale value corresponded to the subpixel.

Beneficial effects of the present disclosure: A driving method for a liquid crystal display panel of the present disclosure, in a first stage of the N+1th frame, makes the first to the mth scan lines respectively control the first row to the mth row of subpixels to be sequentially turned on to make the m+1th to the 2mth of the scan lines respectively control the m+1th row to the 2mth row of the subpixels to be sequentially turned on, and transmits the overdrive voltage corresponded to the overdrive grayscale value to the subpixel during each subpixel being turned on; and in a second stage of the N+1th frame, makes the first to the mth of the scan lines respectively control the first row to the mth row of the subpixels to be sequentially turned on to make the m+1th to the 2mth of the scan lines respectively control the m+1th row to the 2mth row of the subpixels to be sequentially turned on, and transmits the driving voltage corresponded to the second grayscale value to the subpixel during each subpixel being turned on. Furthermore, the nth scan line and the n+mth scan line are simultaneously turned on, which has a short action time of the overdrive, and the response time of the liquid crystal display panel is improved.

DESCRIPTION OF DRAWINGS

In order to further understand the features and technical contents of the present disclosure, please refer to the following detailed description and accompanying figures regarding to the present disclosure. The accompanying figures are provided for reference and description only and are not intended to limit the present disclosure.

In accompanying figures.

DETAILED DESCRIPTION OF PREFERRED EMBODIMENTS

In order to further clarify the technical means and effects of the present disclosure, the following will be made in combined with the preferred embodiment of the present disclosure and the accompanying drawings for describing in detail.

Figure 1:
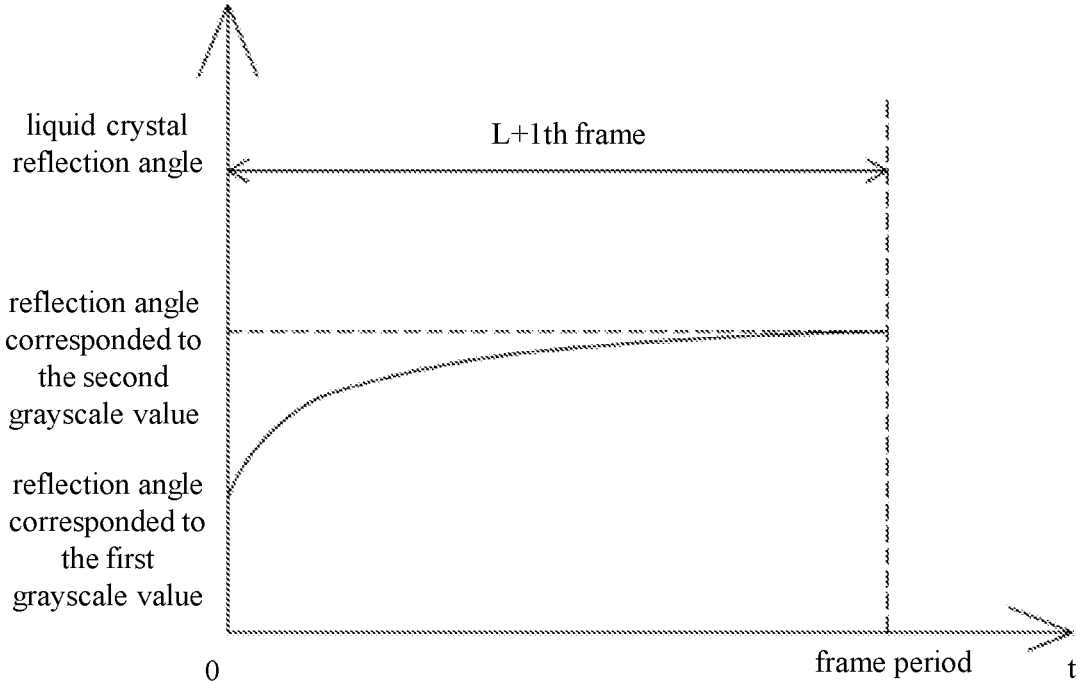
FIG. 1 is a schematic diagram of a change of deflection angles of liquid crystals of subpixels of a L+1th frame of an overdrive technology in the prior art.
Figure 2:
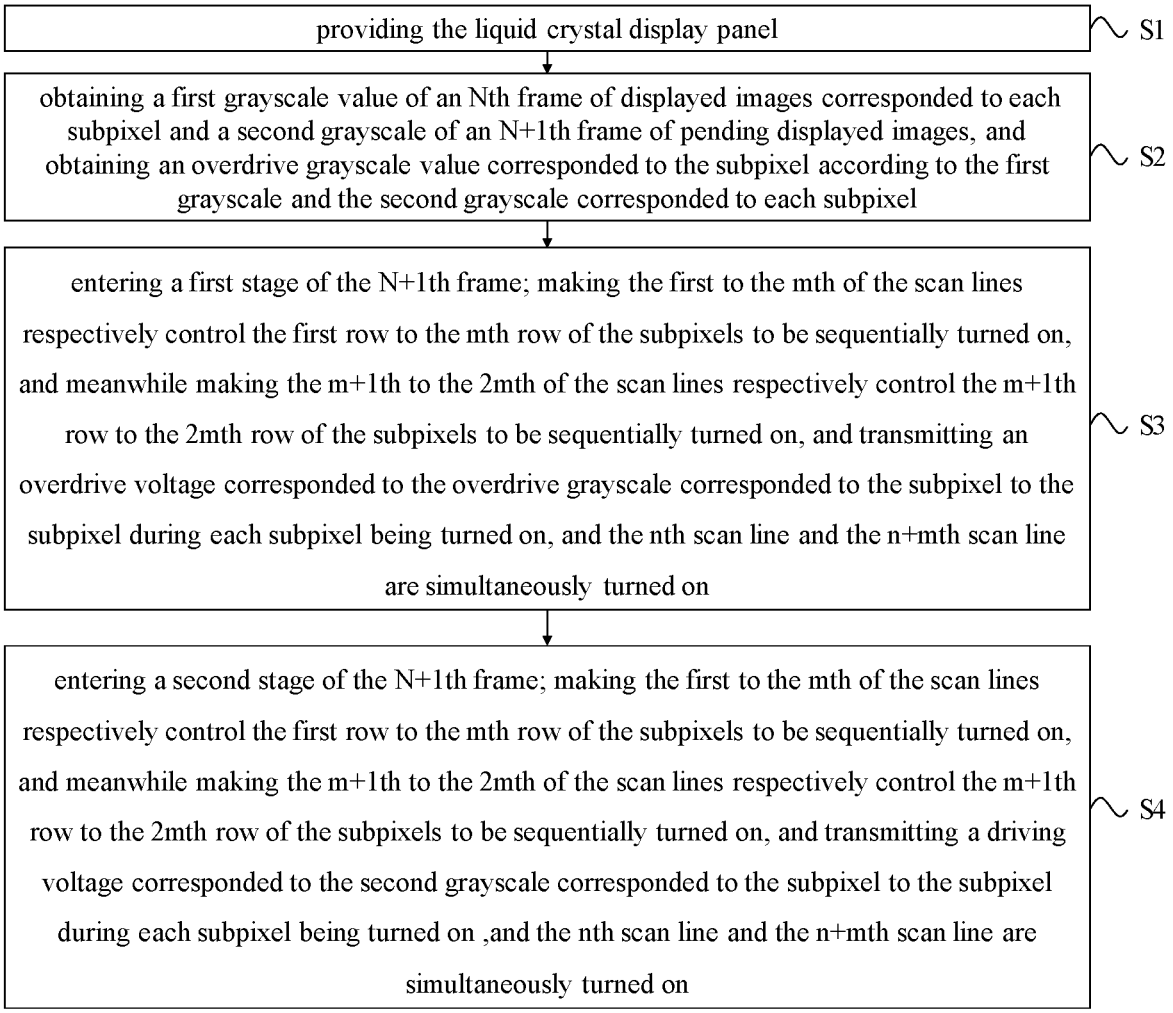
FIG. 2 is a flowchart of a driving method for a liquid crystal display panel of the present disclosure.
Figure 3:
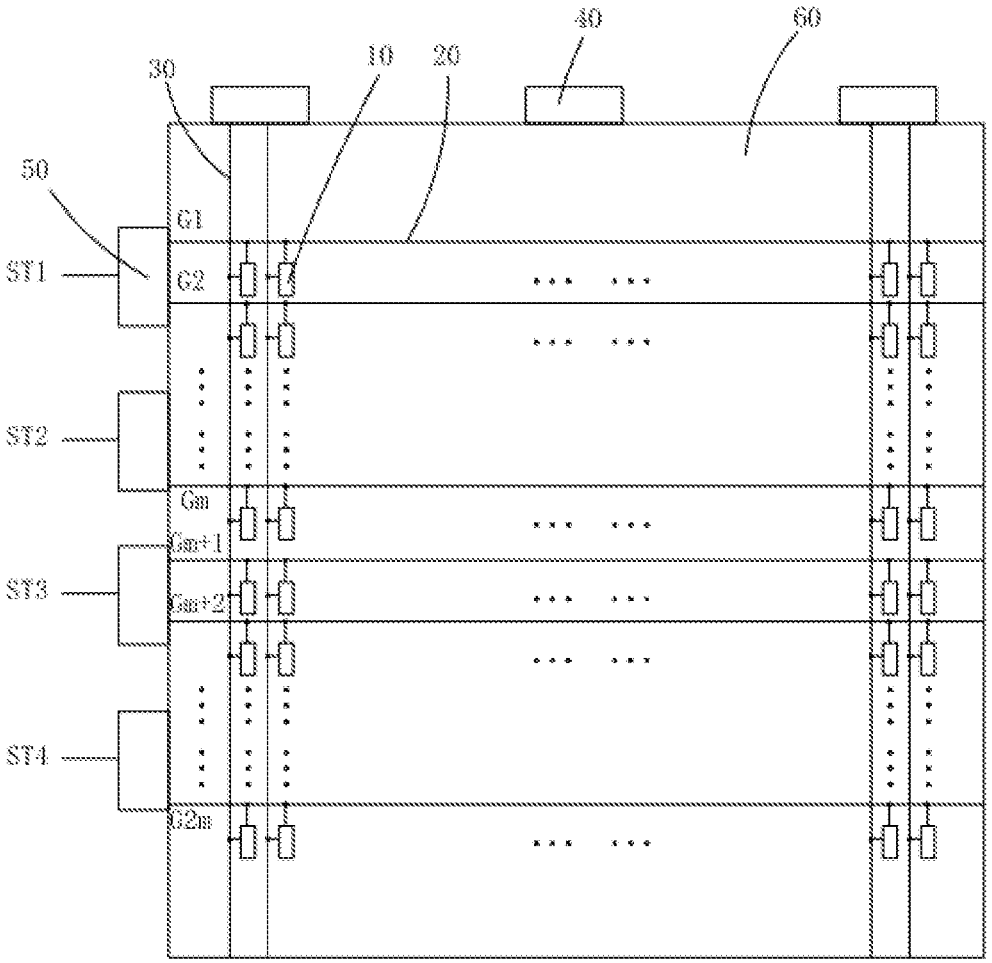
FIG. 3 is a schematic diagram of the step S1 of the driving method for the liquid crystal display panel of the present disclosure.

Please refer to FIG. 2, the present disclosure provides an driving method for a liquid crystal display panel, including steps as follows:

Step S1, please refer to FIG. 3, which is providing the liquid crystal display panel. The liquid crystal display panel includes a plurality of subpixels 10, 2m scan lines 20. Each row of the subpixels 10 are correspondingly electrically connected to one of the scan lines 20, and wherein m is a positive integer.

Specifically, please refer to FIG. 3, the liquid crystal display panel includes a plurality of data lines 30, and each row of the subpixels 10 are correspondingly electrically connected to one of the data lines 30.

Furthermore, please refer to FIG. 3, the liquid crystal display panel further includes a plurality of source drivers 40. The source drivers 40 are respectively electrically connected to the plurality of data lines 30. In the embodiment illustrated in FIG. 3, the liquid crystal display panel includes three source drivers 40. The plurality of data lines 30 are divided into three groups which are disposed sequentially, and each group of the data lines is correspondingly electrically connected to one source driver 40.

Specifically, please refer to FIG. 3, the liquid crystal display panel further includes base 60. The plurality of subpixels 10, the 2m scan lines 20, and the plurality of data lines 30 are disposed on the base 60.

Figure 4:
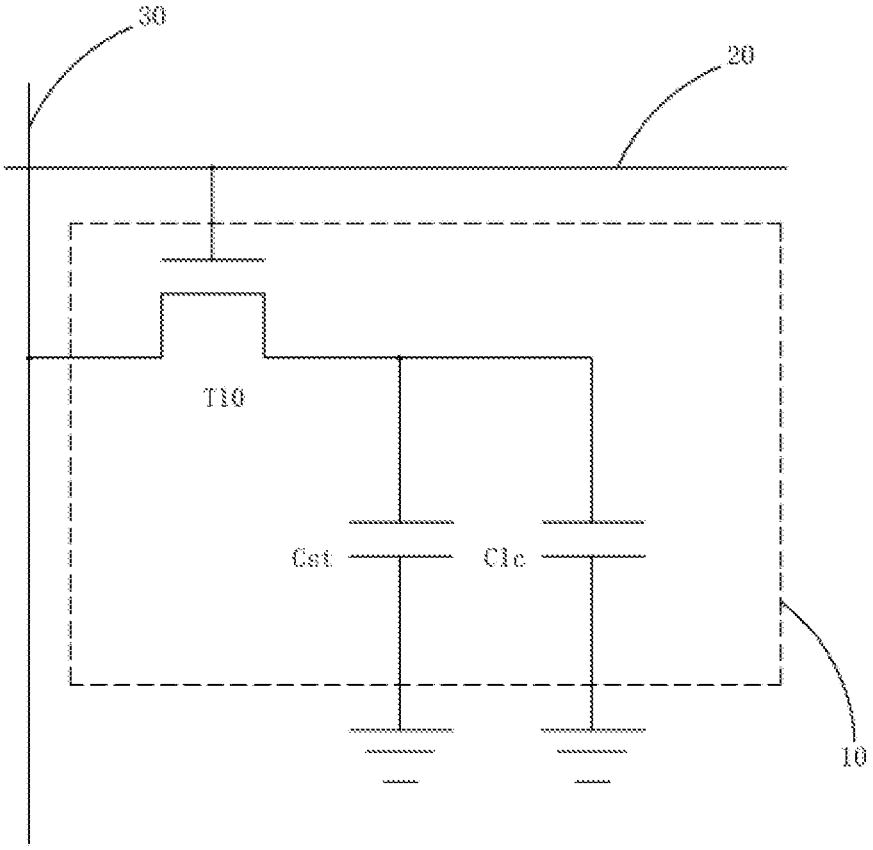
FIG. 4 is a structural schematic diagram of subpixels of the liquid crystal display panel of the driving method for the liquid crystal display panel of the present disclosure.

Specifically, please refer to FIG. 4, each of the subpixels 10 includes a thin film transistor T10, a storage capacitor Cst, and a liquid crystal capacitor Clc. A gate electrode of the thin film transistor T10 is electrically connected to the corresponding data line 20, a drain electrode of the thin film transistor is electrically connected to the corresponding data line 30, and a source electrode of the thin film transistor is electrically connected to one end of the storage capacitor Cst. Another end of the storage capacitor Cst is grounded. One end of the liquid crystal capacitor Clc is electrically connected to the source electrode of the thin film transistor T10, and another end of the liquid crystal capacitor Clc is grounded.

Specifically, please refer to FIG. 3, the liquid crystal display panel includes 2i gate drivers, wherein i is a positive integer. The first to the ith of the gate drivers 50 are respectively electrically connected to the first to the mth of the scan lines 20, and the i+1th to the 2ith of the gate drivers 50 are respectively electrically connected to the m+1th to the 2mth of the scan lines 20. Each gate electrode 50 is accessed a start control signal, and after a rising edge of the accessed start control signal arrives, each gate driver 50 sequentially transmits the scanning signal to the connected scan lines 20.

Furthermore, a number of the gate drivers 50 is less than a number of the scan lines 20, and each gate driver 50 is electrically connected to at least two of the scan lines 20. The first to the mth of the scan lines 20 are divided into i groups which are disposed sequentially. Each group of the scan lines 20 are correspondingly electrically connected to one of the first to the ith of the gate drivers 50. The m+1th to the 2mth scan lines 20 are also divided into i groups which are disposed sequentially. Each group of the scan lines 20 are correspondingly electrically connected to one of the i+1th to the 2ith of the gate drivers 50. In the embodiment illustrated in FIG. 3, i is 2, that is, the number of the gate drivers is four. The four gate electrode 50 are accessed a first start control signal ST1, a second start control signal ST2, a third start control signal ST3, and a fourth start control signal ST4.

Preferably, the nth scan line is electrically connected to the n+mth scan line.

Step S2, obtaining a first grayscale value of an Nth frame of displayed images and a second grayscale value of an N+1th frame of pending displayed images which are corresponded to each subpixel 10. Obtaining an overdrive grayscale value corresponded to the subpixel 10 according to the first grayscale and the second grayscale value corresponded to each subpixel 10, and wherein N is a positive integer.

Figure 5:
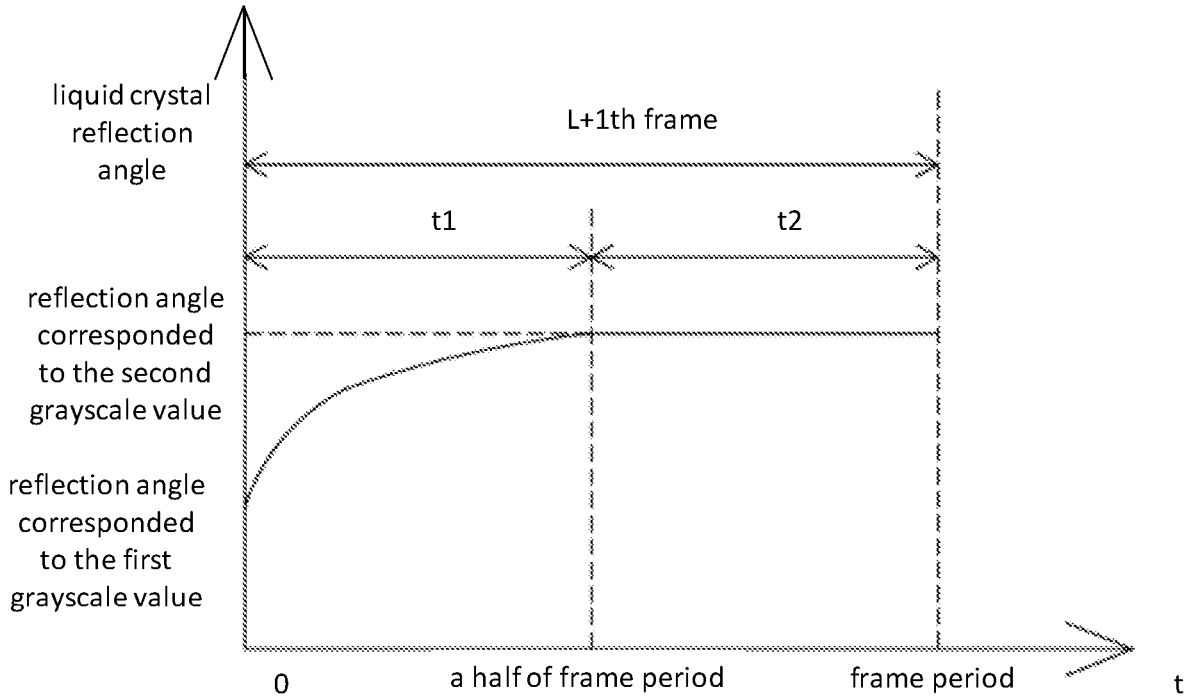
FIG. 5 is a schematic diagram of a schematic diagram of the step S3 and the step S4 of the driving method for the liquid crystal display panel of the present disclosure.

Specifically, the step S2 is specifically that providing an overdrive lookup table. The overdrive grayscale value includes a plurality of grayscale interpolations, and each grayscale interpolation is corresponded to a combination of a previous frame grayscale value and a present frame grayscale value, and the grayscale interpolation corresponded to the combination of the first grayscale value and the second grayscale value corresponded to each subpixel 10 searched from the overdrive lookup table acts as the overdrive grayscale value corresponded to the subpixel 10. For example, if the first grayscale value and the second grayscale value corresponded to the subpixel 10 are 32 and 100, the grayscale interpolation corresponded to the previous frame grayscale value of 32 and the present frame grayscale value of 100 in the overdrive lookup table is 150, then making 150 act as the overdrive grayscale value corresponded to the subpixel 10.

step S3, please refer to FIG. 5, entering a first stage of the N+1th frame:

Making the first to the mth of the scan lines 20 respectively control the first row to the mth row of the subpixels 10 to be sequentially turned on, and meanwhile making the m+1th to the 2mth of the scan lines 20 respectively control the m+1th row to the 2mth row of the subpixels 10 to be sequentially turned on. Furthermore, the nth scan lines and the n+mth scan lines are turned on simultaneously, and wherein n is a positive integer, and n is greater than or equal to 1 and less than or equal to m. That is, in the first stage t1, making the first scan line G1 and the m+1th scan line Gm+1 respectively turn on the first row of the subpixels 10 and the m+1th row of the subpixels 10, and then making the second scan line G2 and the m+2th scan line Gm+2 respectively turn on the second row of the subpixels 10 and the m+2th row of the subpixels 10, and so forth. At last, making the mth scan line Gm and the 2mth scan line G2*m* respectively turn on the mth row of the subpixels 10 and the 2mth row of the subpixels 10, and transmitting the overdrive grayscale value corresponded to the overdrive grayscale value corresponded to the subpixel 10 to the subpixel 10 during each subpixel 10 being turned on. For example, in the first stage t1, when the subpixel 10 having the corresponding first grayscale value and the corresponding second grayscale value being respectively 32 and 100 is turned on, transmitting the overdrive voltage corresponded to the overdrive grayscale value 150 thereto.

Specifically, in the step S3, using the corresponding data lines 30 to transmit the overdrive grayscale value corresponded to the overdrive grayscale value corresponded to the subpixel 10 to the subpixel 10 during each subpixel 10 being turned on.

Furthermore, in the step S3, using the corresponding data lines 30 to transmit the overdrive grayscale value corresponded to the overdrive grayscale value corresponded to the subpixel 10 to the subpixel 10 by the source drivers 40 electrically connected to the corresponding data lines 30 during each subpixel 10 being turned on.

Specifically, in the step S3, using the first to the ith of the gate drivers 50 to sequentially transmit the scanning signals to the first to the mth of the scan lines 20, making the first to the mth of the scan lines 20 respectively control the first row to the mth row of the subpixels 10 to be sequentially turned on, and meanwhile using the i+1th to the 2ith of the gate drivers 50 to sequentially transmit the scanning signals to the m+1th to the 2mth of the scan lines 20, making the m+1th to the 2mth of the scan lines 20 respectively control the m+1th row to the 2mth row of the subpixels 10 to be sequentially turned on, and the nth scan line and the n+mth scan line are simultaneously turned on.

Specifically, in the embodiment illustrated in FIG. 5, a duration of the first stage t1 of the N+1th frame is a half of a preset frame period. In the first stage t1, applying the overdrive voltage to liquid crystals of each subpixel 10 to make the liquid crystals to deflect rapidly, which makes the liquid crystals of each subpixel 10 in a half of the frame period enable to deflect to the corresponding deflection angle corresponded to the second grayscale value, thereby making each subpixel 10 enable to display the corresponded second grayscale value, and the overdrive is finished.

Of course, in another embodiment of the present disclosure, a duration of the first stage t1 of the N+1th frame may also be less than a half of a preset frame period, which does not affect the implementation of the present disclosure.

Step S4, please refer to FIG. 5, entering a second stage t2 of the N+1th frame:

Making the first to the mth of the scan lines 20 respectively control the first row to the mth row of the subpixels 10 to be sequentially turned on, and meanwhile making the m+1th to the 2mth of the scan lines 20 respectively control the m+1th row to the 2mth row of the subpixels 10 to be sequentially turned on. Transmitting a driving voltage corresponded to the second grayscale value corresponded to the subpixel 10 to the subpixel 10 during each subpixel 10 being turned on. Furthermore, the nth scan line and the n+mth scan line are simultaneously turned on. For example, in the second stage t2, when the subpixel 10 having the corresponding first grayscale value and the corresponding second grayscale value being respectively 32 and 100 is turned on, transmitting the overdrive voltage corresponded to the second grayscale value 100 thereto.

Specifically, in the step S4, using the corresponding data lines 30 to transmit the driving voltage corresponded to the second grayscale value corresponded to the subpixel 10 to the subpixel 10 during each subpixel 10 being turned on.

Furthermore, in the step S4, using the corresponding data lines 30 to transmit the driving voltage corresponded to the second grayscale value corresponded to the subpixel 10 to the subpixel 10 by the source drivers 40 electrically connected to the corresponding data lines 30 during each subpixel 10 being turned on.

Specifically, in the step S4, using the first to the ith of the gate drivers 50 to sequentially transmit the scanning signals to the first to the mth of the scan lines 20, making the first to the mth of the scan lines 20 respectively control the first row to the mth row of the subpixels 10 to be sequentially turned on, and meanwhile using the i+1th to the 2ith of the gate drivers 50 to sequentially transmit the scanning signals to the m+1th to the 2mth of the scan lines 20, making the m+1th to the 2mth of the scan lines 20 respectively control the m+1th row to the 2mth row of the subpixels 10 to be sequentially turned on, and the nth scan line and the n+mth scan line are simultaneously turned on.

Specifically, in the embodiment illustrated in FIG. 5, the duration of the second stage t2 of the N+1th frame is a half of the preset frame period. In the second stage t2, which received from each subpixel 10 is the driving voltage corresponded to the second grayscale value corresponded to the subpixel 10, that is, which is performed in the second stage t2 is a normal drive and is not the overdrive, thereby comparing to the prior art, the driving method for the liquid crystal display panel of the present disclosure only performs the overdrive in the first stage t1 of the N+1th frame, and does not perform the overdrive in the second stage t2. The action time of the over drive is changed from a whole frame period in the prior art to a half of the frame period. The action time of the overdrive is reduced greatly, making the response tome of the liquid crystal display panel be improved greatly.

In summary, a driving method for a liquid crystal display panel of the present disclosure, in a first stage of the N+1th frame, makes the first to the mth scan lines respectively control the first row to the mth row of subpixels to be sequentially turned on to make the m+1th to the 2mth of the scan lines respectively control the m+1th row to the 2mth row of the subpixels to be sequentially turned on, and transmits the overdrive voltage corresponded to the overdrive grayscale value to the subpixel during each subpixel being turned on; and in a second stage of the N+1th frame, makes the first to the mth of the scan lines respectively control the first row to the mth row of the subpixels to be sequentially turned on to make the m+1th to the 2mth of the scan lines respectively control the m+1th row to the 2mth row of the subpixels to be sequentially turned on, and transmits the driving voltage corresponded to the second grayscale value to the subpixel during each subpixel being turned on. Furthermore, the nth scan line and the n+mth scan line are simultaneously turned on, which has a short action time of the overdrive, and the response time of the liquid crystal display panel is improved.

In the above, for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A driving method for a liquid crystal display panel, comprising steps as follows:

step S1, providing the liquid crystal display panel, wherein the liquid crystal display panel comprises a plurality of subpixels, 2m scan lines, and each row of the subpixels are correspondingly electrically connected to one of the scan lines, and wherein m is a positive integer;

step S2, obtaining a first grayscale value of an Nth frame of displayed images and a second grayscale value of an N+1th frame of pending displayed images which are corresponded to each subpixel; and obtaining an overdrive grayscale value corresponded to the subpixel according to the first grayscale and the second grayscale value corresponded to each subpixel, and wherein N is a positive integer;

step S3, entering a first stage of the N+1th frame, making the first to the mth of the scan lines respectively control the first row to the mth row of the subpixels to be sequentially turned on; meanwhile making the m+1th to the 2mth of the scan lines respectively control the m+1th row to the 2mth row of the subpixels to be sequentially turned on; and transmitting an overdrive voltage corresponded to the overdrive grayscale value corresponded to the subpixel to the subpixel during each subpixel being turned on; wherein the nth scan line and the n+mth scan line are simultaneously turned on; wherein n is a positive integer, and n is greater than 1 and less than m; and step S4, entering a second stage of the N+1th frame, making the first to the mth of the scan lines respectively control the first row to the mth row of the subpixels to be sequentially turned on; meanwhile making the m+1th to the 2mth of the scan lines respectively control the m+1th row to the 2mth row of the subpixels to be sequentially turned on; and transmitting a driving voltage corresponded to the second grayscale value corresponded to the subpixel to the subpixel during each subpixel being turned on; wherein the nth scan line and the n+mth scan line are simultaneously turned on.

2. The driving method for the liquid crystal display panel as claimed in claim 1, wherein a duration of the first stage of the N+1th frame is a half of a preset frame period, and a duration of the second stage of the N+1th frame is a half of the preset frame period.

3. The driving method for the liquid crystal display panel as claimed in claim 1, wherein a duration of the first stage of the N+1th frame is less than a half of a preset frame period.

4. The driving method for the liquid crystal display panel as claimed in claim 1, wherein the liquid crystal display panel comprises a plurality of data lines, and each row of the subpixels are correspondingly electrically connected to one of the data lines;

in the step S3, using the corresponding data lines to transmit the overdrive voltage corresponded to the overdrive grayscale value corresponded to the subpixel to the subpixel during each subpixel being turned on; and in the step S4, using the corresponding data lines to transmit the driving voltage corresponded to the second grayscale value corresponded to the subpixel to the subpixel during each subpixel being turned on.

5. The driving method for the liquid crystal display panel as claimed in claim 4, wherein the liquid crystal display panel comprises a plurality of source drivers, and the source drivers are respectively electrically connected to the plurality of data lines;

in the step S3, using the corresponding data lines to transmit the overdrive voltage corresponded to the overdrive grayscale value corresponded to the subpixel to the subpixel by the source drivers electrically connected to the corresponding data lines during each subpixel being turned on; and in the step S4, using the corresponding data lines to transmit the driving voltage corresponded to the second grayscale value corresponded to the subpixel to the subpixel by the source drivers electrically connected to the corresponding data lines during each subpixel being turned on.

6. The driving method for the liquid crystal display panel as claimed in claim 4, wherein each subpixel comprises a thin film transistor, a storage capacitor, and a liquid crystal capacitor; a gate electrode of the thin film transistor is electrically connected to the corresponding data line, a drain electrode of the thin film transistor is electrically connected to the corresponding data line, and a source electrode of the thin film transistor is electrically connected to one end of the storage capacitor; another end of the storage capacitor is grounded; and one end of the liquid crystal capacitor is electrically connected to the source electrode of the thin film transistor, and another end of the liquid crystal capacitor is grounded.

7. The driving method for the liquid crystal display panel as claimed in claim 1, wherein the liquid crystal display panel comprises 2i gate drivers, wherein i is a positive integer, the first to the ith of the gate drivers are respectively electrically connected to the first to the mth of the scan lines, and the i+1th to the 2ith of the gate drivers are respectively electrically connected to the m+1th to the 2mth of the scan lines;

in the step S3, using the first to the ith of the gate drivers to sequentially transmit scanning signals to the first to the mth of the scan lines, making the first to the mth of the scan lines respectively control the first row to the mth row of the subpixels to be sequentially turned on; meanwhile using the i+1th to the 2ith of the gate drivers to sequentially transmit scanning signals to the m+1th to the 2mth of the scan lines, making the m+1th to the 2mth of the scan lines respectively control the m+1th row to the 2mth row of the subpixels to be sequentially turned on, and the nth the scan line and the n+mth scan line are simultaneously turned on; and in the step S4, using the first to the ith of the gate drivers to sequentially transmit the scanning signals to the first to the mth of the scan lines, making the first to the mth of the scan lines respectively control the first row to the mth row of the subpixels to be sequentially turned on; meanwhile using the i+1th to the 2ith of the gate drivers to sequentially transmit the scanning signals to the m+1th to the 2mth of the scan lines, making the m+1th to the 2mth of the scan lines respectively control the m+1th row to the 2mth row of the subpixels to be sequentially turned on, and the nth scan line and the n+mth scan line are simultaneously turned on.

8. The driving method for the liquid crystal display panel as claimed in claim 7, wherein a number of the gate drivers is less than a number of the scan lines, and each gate driver is electrically connected to at least two of the scan lines;

each gate electrode is accessed a start control signal, and after a rising edge of the accessed start control signal arrives, each gate driver sequentially transmits the scanning signal to the at least two of the connected scan lines.

9. The driving method for the liquid crystal display panel as claimed in claim 1, wherein the nth scan line is electrically connected to the n+mth scan line.

10. The driving method for the liquid crystal display panel as claimed in claim 1, wherein the step S2 comprises: providing an overdrive lookup table, wherein the overdrive grayscale value comprises a plurality of grayscale interpolations, and each grayscale interpolation is corresponded to a combination of a previous frame grayscale value and a present frame grayscale value, and the grayscale interpolation corresponded to the combination of the first grayscale value and the second grayscale value corresponded to each subpixel searched from the overdrive lookup table acts as the overdrive grayscale value corresponded to the subpixel.

* * * * *